US006038793A

United States Patent [19]

Kendall

[11] Patent Number: 6,038,793

[45] Date of Patent: Mar. 21, 2000

[54] ORTHOTIC SYSTEM

[76] Inventor: Michael Kendall, 2731 Loker Ave. West, Carlsbad, Calif. 92008

[21] Appl. No.: 09/203,830

[22] Filed: Dec. 1, 1998

Related U.S. Application Data

[60] Continuation of application No. 08/805,979, Feb. 24, 1997, which is a division of application No. 08/486,323, Jun. 6, 1995, Pat. No. 5,713,143.

[51] Int. Cl.[7] ..... A43B 7/16

[52] U.S. Cl. ..... 36/173; 36/80

[58] Field of Search ..... 36/71, 80, 140, 36/145, 173, 174

[56] References Cited

U.S. PATENT DOCUMENTS

| | | | |
|---|---|---|---|
| 2,255,100 | 9/1941 | Brady | 36/173 |
| 2,660,814 | 12/1953 | Ritchey | 36/173 |
| 4,346,525 | 8/1982 | Larsen et al. | 36/69 |
| 4,360,027 | 11/1982 | Friedlander et al. | 36/140 |
| 4,628,936 | 12/1986 | Langer et al. | 36/43 X |
| 4,955,148 | 9/1990 | Padilla | 36/44 |
| 4,979,318 | 12/1990 | Cohen | 36/43 |
| 5,058,585 | 10/1991 | Kendall et al. | 36/140 |
| 5,184,409 | 2/1993 | Brown | 36/173 X |
| 5,187,885 | 2/1993 | Murphy | 36/127 |
| 5,611,153 | 3/1997 | Fisher et al. | 36/43 |

*Primary Examiner*—B. Dayoan
*Attorney, Agent, or Firm*—Foley & Lardner

[57] ABSTRACT

An orthotic system includes a combination partial insole, heel cup and metatarsal pad. The combination partial insole is comprised of the heel cup, a modified metatarsal pad, a midfoot support and a longitudinal arch support. The heel cup and metatarsal pad may be used separately or in combination. Each of the structural elements of the system are designed to control the motion of a human foot during gait, as well as to attenuate shock to the foot during gait. Each of the structural elements of the system are self-adjustable for variations in foot and shoe size and are formed of a compression-resistant, deformable material without rigid components.

6 Claims, 9 Drawing Sheets

•CENTER LINE REPRESENTS ZERO DEVIATION INTO SUPINATION OR PRONATION.
•SOLID LINE THROUGH GRAPH INDICATES PROOF OF PRONATION RESTRICTION VERSES DASHED LINE (WITHOUT ORTHOTICS), WHICH SHOWS GREATER PRONATION.

•CENTER LINE REPRESENTS ZERO DEVIATION INTO SUPINATION OR PRONATION.
•SOLID LINE THROUGH GRAPH INDICATES PROOF OF PRONATION RESTRICTION VERSES DASHED LINE (WITHOUT ORTHOTICS), WHICH SHOWS GREATER PRONATION.

- INVENTION WAS TESTED AGAINST TWO FOAMS RECOGNIZED AS LEADERS IN SHOCK ATTENUATION.
- THE LOWER FIGURE INDICATES MORE EFFECTIVE SHOCK ABSORBANCY.
- INVENTION SHOWS CUTTING EDGE SHOCK ABSORBANCY.

ORTHOTIC SYSTEM

This is a continuation of U.S. application Ser. No. 08/805,979, filed Feb. 24 1997, which is a divisional of U.S. application Ser. No. 08/486,323, filed Jun. 6, 1995, now U.S. Pat. No. 5,713,143.

BACKGROUND OF THE INVENTION

1. Field of the Invention

This invention relates to devices for supporting the foot of a human user and controlling the stresses applied thereto while the user is standing or in gait. In particular, the invention relates to orthopaedic orthotic devices for insertion into a shoe.

2. Description of Related Art

Most orthotic devices are designed to distribute the stresses of weightbearing to areas of the foot which can best tolerate such stresses, in order to maximize comfort and minimize trauma to the sole of the foot. Such an orthosis provides a padded surface which may be flat, or which may be shaped to conform with the contours of a particular foot (a custom molded orthosis) or an average foot (a non-custom orthosis). Non-custom accommodative orthoses tend to be either significantly flatter than the average sole, or to be fabricated from a soft material which compresses under loads of less than about 5% of body weight so as to be tolerated across a population possessing wide variations in sole contour. Such devices may increase foot comfort, but are unlikely to provide significant control of foot motion.

A corrective orthosis, on the other hand, is designed to guide and restrict the motion of joints of the foot in order to improve gait efficiency and to reduce the stresses imposed on lower extremity anatomical structures during gait. As a rule, corrective orthoses are fabricated of firmer materials than are devices intended simply to provide comfort to the foot. The main goal of most corrective orthoses is to resist pronation, a complex foot motion which produces the partial collapse of the medial longitudinal arch of the foot, best seen during the midstance phase of the gait cycle.

Pronation actually consists of the abduction, eversion, and dorsiflexion of the forefoot in relation to the rearfoot. Because of the close contiguity of the joints involved, pronation is always accompanied by eversion of the heel and internal rotation of the leg and hip. While pronation is a normal part of gait, it is now well established that excessive pronation is the source of many lower extremity pathologies, including muscle tiredness and inflammation, foot and knee joint pain, tendinitis, ligament strain, and even neurological damage. Excessive pronation also renders the gait less efficient since time and effort is wasted in collapsing (pronating) and recovering (supinating). It has been estimated that up to 70% of the population overpronates to some degree.

Peak forces transmitted through the feet during running can easily exceed three times body weight. In order to resist such forces, a functional orthosis must be fabricated of a firm material. To remain comfortable and to avoid painful high pressure spots, it must also conform closely to the contours of the sole of the foot in its neutral position. Proper arch height is particularly critical in a functional orthosis. If the arch is too high, the device will be intolerably painful. On the other hand, if the arch is too low, control of pronation will be sacrificed. Significantly, due to the high forces transmitted through feet during gait, small variations in the form and material of orthoses can produce profound differences in orthosis function and comfort.

To satisfy the dual requirements of firm support and precisely contoured fit, prior art corrective orthoses have generally ben produced from a custom mold of an individual foot. In addition to the disadvantages of the tedium and expense of the custom-molding procedure, such prescription devices frequently require modifications subsequent to fitting.

Further, currently available corrective orthoses are plagued by several additional shortcomings. First, these devices are typically bulky. To accommodate the orthosis, a shoe's insole, if present, must typically be removed or the shoe must be replaced with another of larger size. In either case, the fit of the shoe is altered. Moreover, insertion of such a device into the shoe raises the center of gravity of the foot within the shoe, thereby destablizing the foot. By changing the fit of the shoe, these devices frequently counteract the supportive design features of the shoe.

Another disadvantage shared by currently available corrective orthoses is that they are typically fabricated of rigid material, e.g., hard plastics. Prolonged wear of such rigid devices causes degradation of the foot's plantar fat pad, leading to the formation of painful calluses.

An example of a device which suffers from several of the deficiencies referred to above is shown in Friedlander, et al., U.S. Pat. No. 4,360,027. The device of Friedlander, et al. is apparently intended to control overpronation of the foot during gait. However, unlike the present invention, this function is achieved in part through placement of a "posting" material at supporting points in the Friedlander, et al. device (e.g., the longitudinal arch and heel supporting region). While supportive, posting is a hard, rigid material whose presence in the device requires that it be custom-fitted to avoid pain through exposure of the foot to posting at inappropriate sites (Friedlander, et al., Col. 4, lines 6–9).

The focus of the Friedlander, et al. device on the control of pronation led to the use of a medial, arch portion of the device which is somewhat thicker and wider than the portion of the device adjacent to the metatarsals of the subject's foot (Friedlander, et al., FIGS. 1 and 3). Although this design facilitates control of pronation, it may also cause additional strain to be placed on the metatarsals of the foot by shifting stress pressure from the middle portion of the foot forward without compensation for the additional strain on the metatarsals.

A need, therefore, exists for an orthotic device capable of addressing many of the etiologies of pain in the foot with minimal intrusion into, and deformation of, the internal space of the shoe in which the device is placed. The present invention meets this need.

SUMMARY OF THE INVENTION

The invention comprises a system for orthotic devices ("orthotic system") which may be used together or individually to address the particular needs of the user. In combination, the system comprises a heel cup , a metatarsal pad, and a combination partial insole including the heel cup and a metatarsal pad. In the preferred embodiment of the invention, each device is formed of a compression-resistant, deformable gel or foam, most preferably a polyurethane gel. Alternatively, regions of each device (described further below) adapt to individual variations in foot structure and shoe size ("accommodative apertures") may be formed of a compressible material, preferably an open or closed cell foam and most preferably a polyurethane foam. No rigid material (e.g., posting) is present in any of the devices.

The orthotic system of the invention possesses several advantages over prior art orthotic devices. First, each device of the system provides support and stability to affected areas of the foot without substantially affecting the fit of the shoe into which the devices are placed. In this respect, the devices of the inventive system allow the user to correct and control the motion of specific regions of the foot without affecting regions which do not require such support or control.

Second, the orthotic system is designed to self-adjust for variations in gait, foot and shoe size among potential users of the devices without the need to custom fit each device to each particular user. In this respect, the adaptability of the devices lowers the expense associated with the use of orthotic devices and limits the need for medical assistance in fitting and prescribing the devices. Further, the devices more readily adapt to both different shoe sizes and types, thus allowing a single set of devices to be used in work shoes, sport shoes, shoes with heels and so forth.

Third, the orthotic system provides shock attenuation and support for the foot without use of rigid materials, such as the posting frequently used in custom orthotic devices. The absence of such rigid materials provides user of the inventive system with a greater degree of comfort, thus allowing the user to employ the system for longer periods of time. Further, lacking any rigid materials, the orthotic system of the invention will move with, rather than against, the motion of the shoe in which it is placed.

BRIEF DESCRIPTION OF THE DRAWINGS

Like reference numbers and designations in FIGS. 2–6 refer to like elements.

DETAILED DESCRIPTION OF THE INVENTION

Throughout this description, the preferred embodiment and examples shown should be considered as exemplars, rather than limitations on the present invention.

Figure 1:
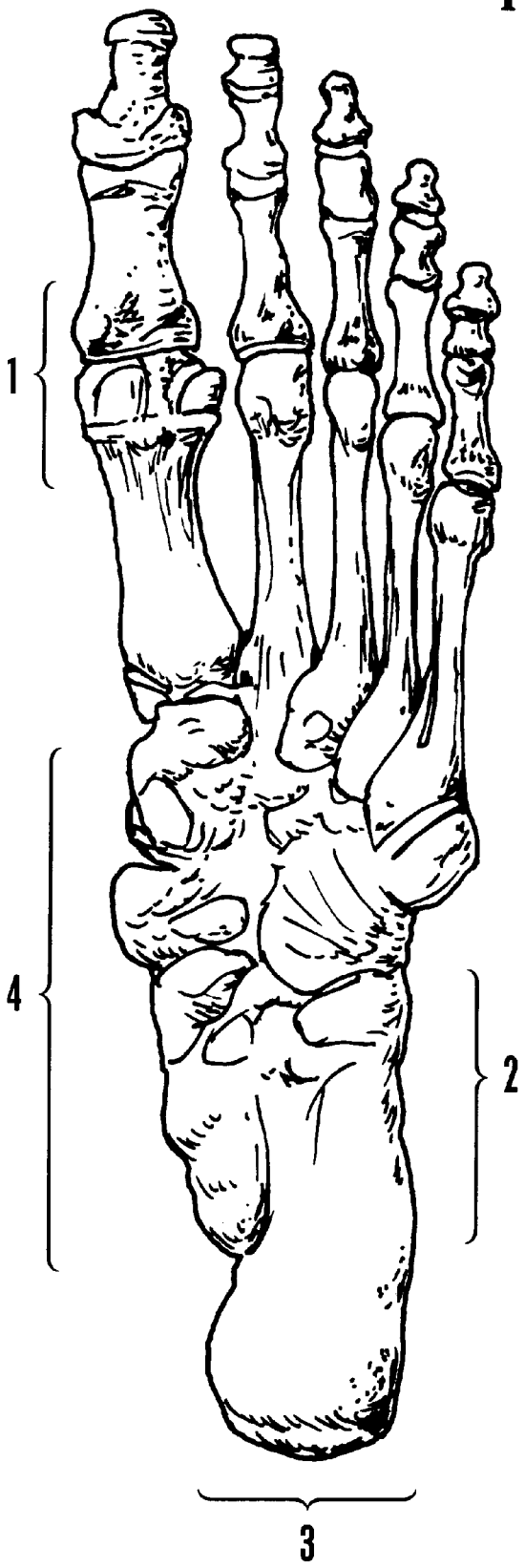
FIG. 1 is an anatomical drawing of a human foot.

For reference throughout this description, FIG. 1 depicts the typical anatomical structure of the human foot. The foot is generally considered to have two surfaces: the plantar (bottom) surface and the dorsal (upper) surface. The foot is depicted from the plantar surface in FIG. 1. Individual tarsal bones are also depicted; the "metatarsals" 1 comprise the medial joint of the individual digits and consist of an arch terminating in metatarsal heads at the point of articulation. The proximal row of tarsal bones consists of the talus 2 and calcaneus (heel) 3 while the distal row contains (mediolaterally) the medial, intermediate and lateral uniforms, as well as the cuboid. Together, the latter tarsal bones curve dorsally convex to form the longitudinal "arch" 4 of the foot.

Figure 2A:
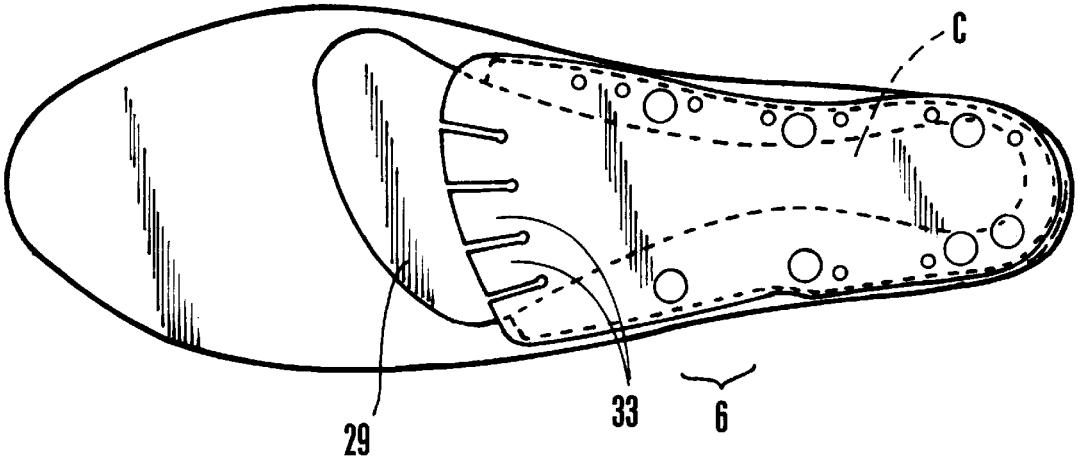
FIGS. 2*a* and 2*b* depict, respectively, a bottom plan and side view of a prior art orthotic device (full insole).
Figure 2B:
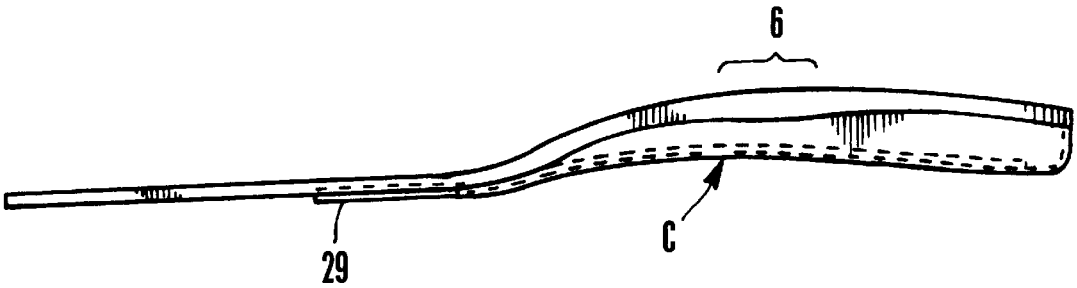

For reference and comparison to the orthotic system of the invention, a typical prior art full insole orthotic device is depicted in FIGS. 2*a* and 2*b* (which device is described in detail in published European Patent Application No. 0173396A2 (Brown, et al., inventors)). As is common in such devices, the orthotic insole is comprised of a semi-solid material which, when placed in a shoe, covers the entire upper surface of the shoe's insole. As shown in FIG. 2*b*, the lowermost portion of the prior art device is formed of a rigid cap "C" over which one or more compressible materials (such as cork and foam) are laminated. Cap C extends from the heel portion of the device 6 forward to a pad 29 which underlies and extends beyond the area of the device intended to support the metatarsal head. Thus, the device raises the heel with respect to the forefoot, placing additional stress on the latter.

Referring to FIG. 2*a*, as described in the published patent application, the sides of the insole at the heel region 6 extend forward and downward in a tapered contour that flattens just prior to joining pad 29 at the metatarsal area of the device. Accommodative apertures 33 are provided through the surface of the compressible laminate to allow the insole to spread at the metatarsal region. In all other respects, however, the configuration of the device is fixed. Moreover, the extent to which the device can be adapted to accommodate variations in gait and shoe size is extremely limited by the joinder of the compressible layers of the insole to the rigid cap. Not only does this aspect of the device limit its comfort, the use of a hard underlayer allows the device to slide against, rather than with, the motion of the shoe in which it is placed.

Comparing the prior art device of FIGS. 2*a* and 2*b* with the heel cup (FIG. 3), metatarsal pad (FIG. 4), and full insole device (FIG. 5) of the invention, the advantages of the orthotic system of the invention become apparent. In the description which follows, "lateral" and "medial" shall be understood to be opposite of one another regardless of whether the particular device described to illustrate the invention is intended to fit into the user's left or right shoe. More specifically, the medial side of a device corresponds to the inner side of the user's foot, while the lateral side of a device corresponds to the outer side of the user's foot.

Further, "anterior" shall refer to the direction toward the user's toes, while "anterior" shall refer to the direction toward the user's heel. Also, "mediolateral" shall refer to an extension of the medial portion of a device toward the lateral side of the user's foot, while "mediomedial" shall refer to an extension of the medial portion of a device toward the medial side of a user's foot.

Figure 3:
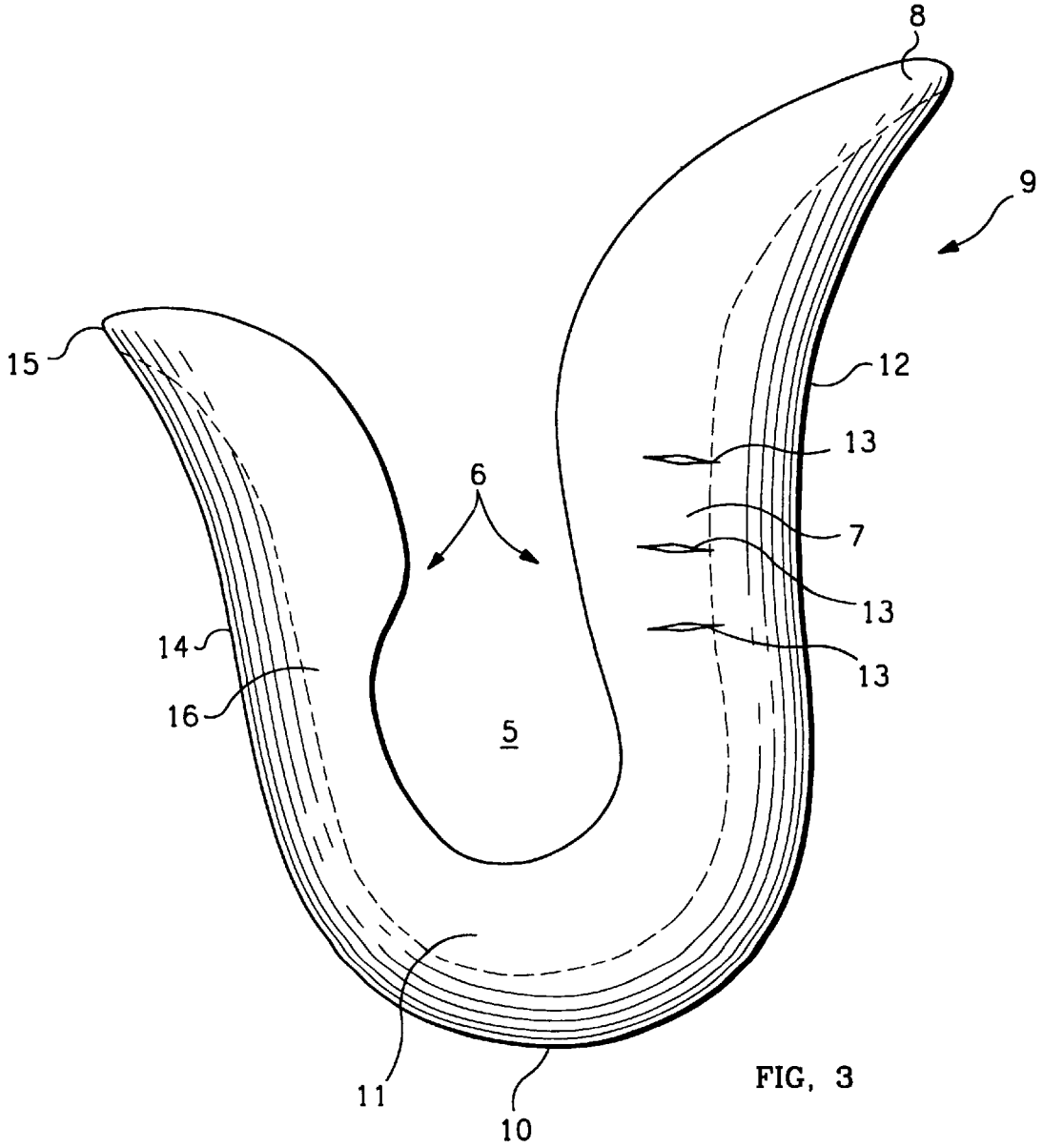
FIG. 3 is a top plan view of a heel cup of the invention (for use in a left shoe).

First with respect to heel cup 9, as shown in FIG. 3, heel cup 9 is configured as a somewhat misshapen "U" (i.e., a "substantially U-shaped" structure), where the arms 12 and 14 of the "U" curve slightly outward from mouth 6 (opposite the bight of the "U") to better conform to the fit of most shoes (which typically widen to accommodate the metatarsal, or ball, area of the foot).

Four areas of support are provided to the plantar surface of the foot (see, FIG. 1) by heel cup 9. First, accommodative aperture 5 extends under the central and anterior plantar aspect of the heel (element 3 in FIG. 1), thus allowing the heel to rest without elevation on the insole of the shoe. Second, heel cradle 10 of heel cup 9 is of sufficient length to wrap the calcaneus bone (heel) medially to laterally. The curvature of the cradle 10 is seatable along the inner surface of the heel of a shoe upper (with the widest aspect of the wedge resting on top of the shoe insole), and may be adjusted to accommodate different heel and/or shoe sizes by rotating medial arm 12 and lateral arm 14 of the heel cup toward or away from one another to open or close mouth 6 of aperture 5.

Most preferably, heel cup 9 will be wedge-shaped in cross-section. The inner surface of the wedge may be concave so as to cup the user's heel. This preferred configuration of heel cup 9 also allows the cup to be seated more securely into the shoe, with less intrusion into the space that the foot will occupy therein.

Third, medial arm 12 of cradle 10 tapers along the longitudinal arch of the foot to at least a point at approximately the anteriormost point of the user's longitudinal arch. Arm 12 is also preferably about 1 to 3 times thicker at point 7 (i.e., at the head of the plantar surface of the talus) than is cradle 10 at point 11. Medial arm 12 thus provides longitudinal support to the foot. To accommodate differences in foot and shoe sizes, medial arm 12 may also be provided with at least one, and most preferably at least 3, accommodative apertures 13. The apertures may be formed of any shape which will allow medial portion 12 to be flexed away from or toward accommodative aperture 5, but will preferably be formed of vertical slices of 1 to 2 mm in depth spaced evenly along the inner surface of medial arm 12.

Fourth, lateral arm 14 of heel cup 9 possesses approximately the same overall configuration as medial arm 12, but is about ⅓ to ⅔ of the latter's width (measured from point 16 in comparison to point 7). Further, at point 16, lateral arm 14 is preferably about the same overall thickness as cradle 10.

In the configuration described, heel cup 9 therefore provides support to the user's longitudinal arch and discourages pronation while cushioning and stabilizing the heel. The dimensions of heel cup 9 will vary depending on their intended user (e.g., adult or child, male or female). Because the heel cup is designed to actively accommodate size differences particularly in shoe or foot widths) relatively few variations in dimension can be used to fit most intended users. However, it can be expected that cradle 10 and arm 14 will vary in thickness from approximately 11 to 19 mm, depending on the size of the user's foot.

Returning to FIG. 1, the metatarsals 1 (articularly the heads) bear nearly all of the pressure distributed to the foot as it "toes-of" to leave the ground in a step. In most people, this pressure is particularly acute along the plantar surface of the second and third metatarsal heads due to the relatively greater length of the second and third metatarsals compared to the other metatarsals of the foot.

In prior art orthotic devices, accommodation of the stress placed on the metatarsal heads during gait is typically achieved by placing a cushioning material beneath the heads (see, e.g., FIG. 2*a* at element 29). However, not only does such a structure reduce the space available in a shoe for the foot at the site of the cushion, but the structure also provides little or no support to the metatarsal arch between the longitudinal arch of the foot and the metatarsal heads. As a result, the force placed on the metatarsal heads during gait is instead distributed in part to the metatarsal arch. This force can be reduced by cushioning the metatarsal arch, but such an approach typically results in compression of the fourth and fifth metatarsals together during gait.

The metatarsal pad of the invention avoids both of these problems by supporting the posterior region of the metatarsal heads rather than the heads themselves. Further, the metatarsal pad extends and tapers rearwardly beneath the plantar surface of the metatarsal arch, supplying it with stress accommodation for the pressure distributed away from the metatarsal heads.

Figure 4:
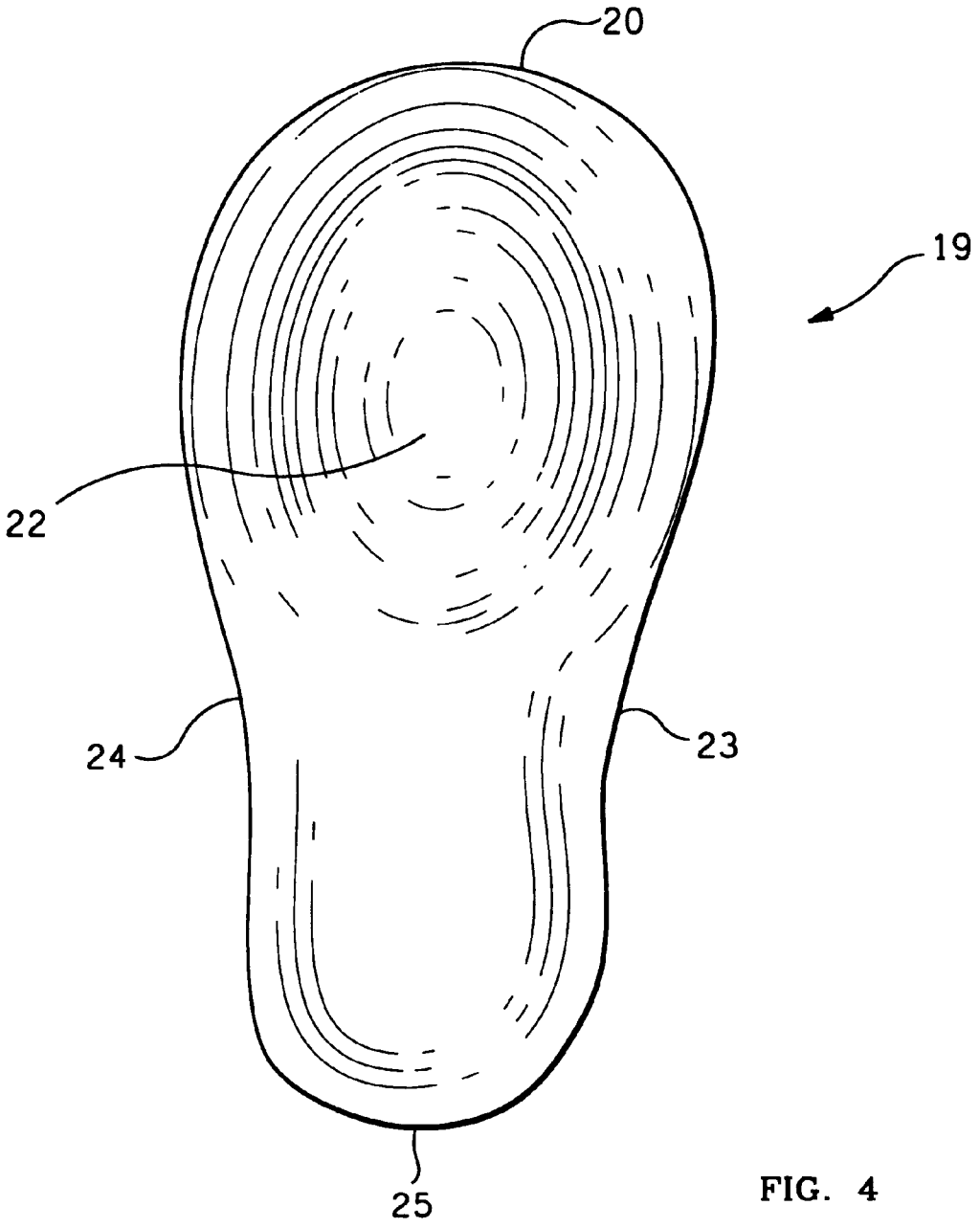
FIG. 4 is a top plan view of a metatarsal pad of the invention (for use in a left shoe).

Specifically, as shown in FIG. 4, the metatarsal pad 19 of the invention has a somewhat bulbous shape. In use, anterior edge 20 of the pad extends substantially across the width of the user's shoe and curves slightly outward to conform to the curvature of the posterior region of the metatarsal heads (FIG. 1, element 21). The upper surface 22 of pad 19 curves convexly upward at an angle of about 2 to 6° from anterior edge 20 to form a pad which will support the metatarsal arch. Ideally, pad 19 will therefore rest in the shoe beneath the user's foot just anterior to the ball of the foot. The upper surface 22 curves downward, posteriously and anteriously so the posterior edge 25 pad 19 is in a level plane with anterior edge 20.

Medial edge 23 of pad 19 is preferably formed along an inward curve from mid portion 22, so at its anterior-most point (along the medial side of the foot) pad 19 curves in and away from the longitudinal arch of the foot. Alternatively, medial edge 23 can continue in a substantially straight path from anterior edge 20. Proximal edge 24 of pad 19 will preferably follow an inward curve or line which is more or less complementary to the curve or line of medial edge 23. In use, in either embodiment, posterior edge 25 terminates anterior to the heel at approximately the posterior edge of the user's metatarsal arch (i.e., posterior to the ball of the foot).

In the configuration described, metatarsal pad 19 provides support both to the arch and to the proximal edge of the midfoot (longitudinal arch region). As a result, the bulk of the pressure placed on the foot during toe-off is shifted from the metatarsal heads to their posterior edge (lifting the heads up to about 1° to 2°) while evening the distribution of force between the metatarsal heads and arch. Pronation away from the point of greatest pressure (at the second and third metatarsals) is discouraged in the preferred embodiment of the metatarsal pad by the presence of tapering posterior edge 24 along the proximal edge of the midfoot.

Figure 5:
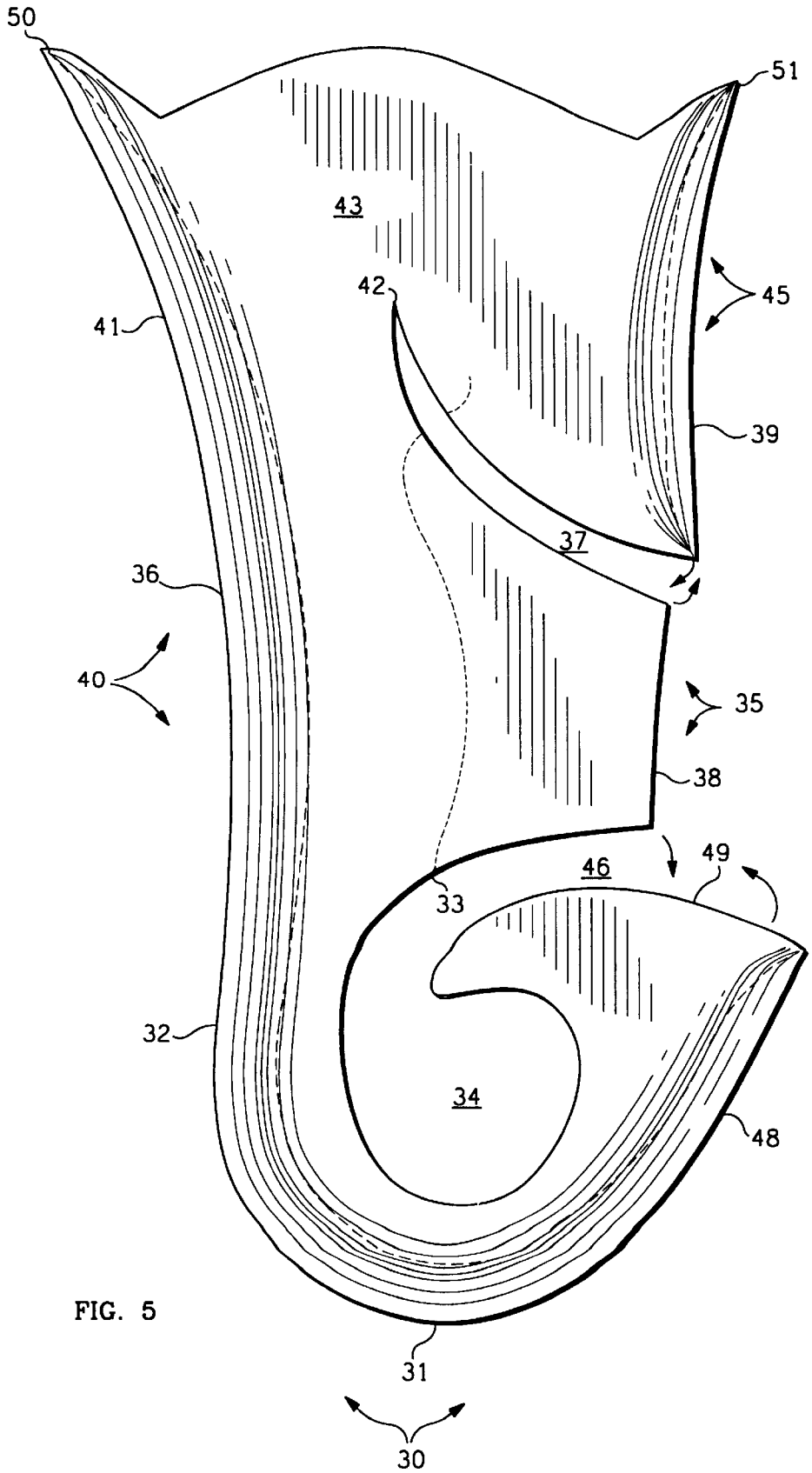
FIG. 5 is a top plan view of a combination partial insole of the invention (for use in a right shoe). The accomodative aperatures are in a partially open position relative to the embodiment shown in FIG. 6.
Figure 6:
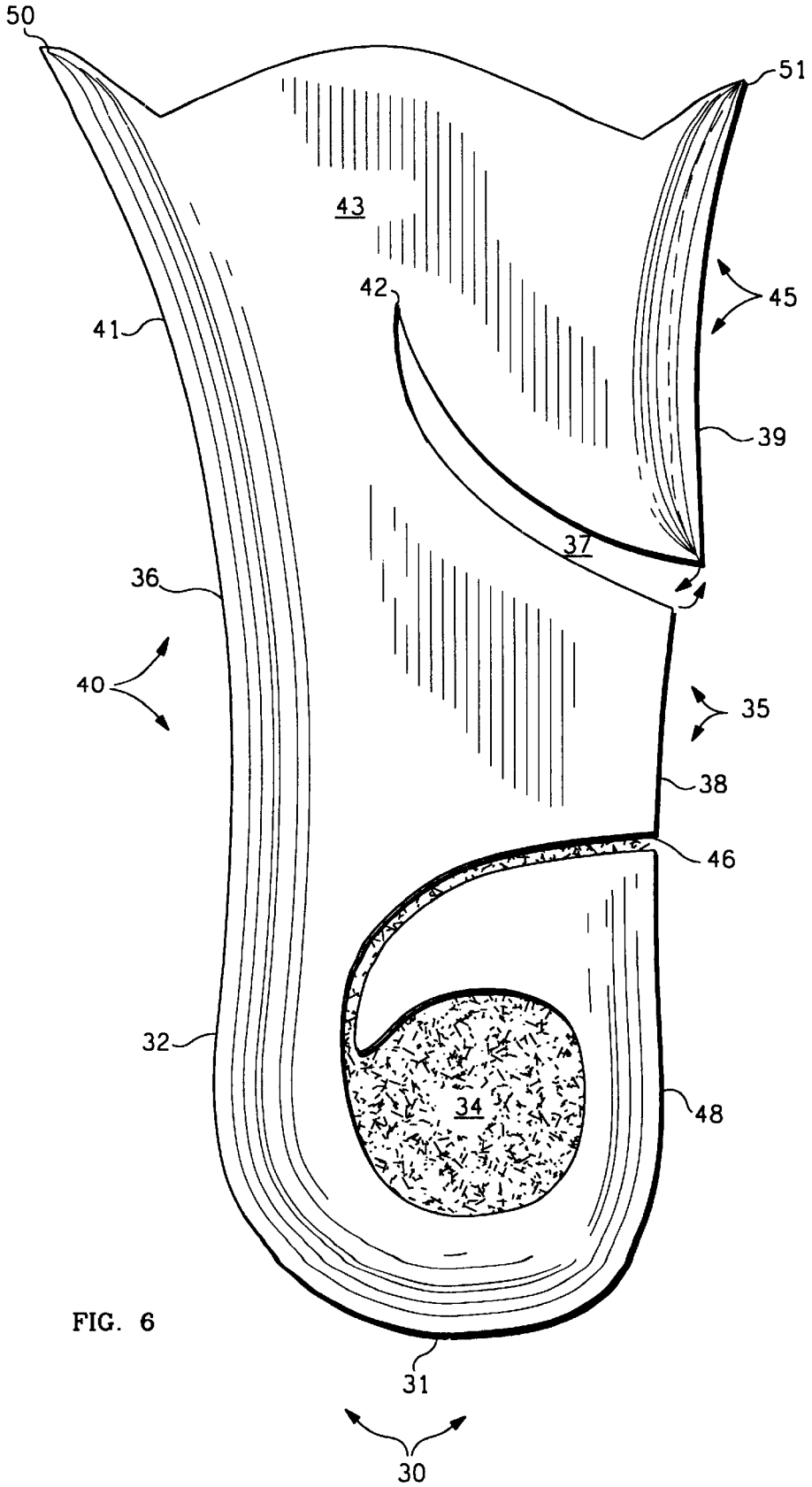
FIG. 6 is a top plan view of a combination partial insole of the invention having filled accommodative apertures therein (for use in a right shoe). The accomodative aperatures are in a partially closed position relative to the embodiment shown in FIG. 5.

FIGS. 5 and 6 depict alternative embodiments of the orthotic system of the invention, which is comprised of a combination of the devices depicted in FIG. 3 and FIG. 4. The orthotic system of the invention is a partial insole that extends in total length along up to two-thirds of the length of the foot (where total length is measured from the calcaneus bone to the end of the longest digit). In this respect, the partial insole avoids the problems associated with the common use of full insoles that cover the entire plantar surface of the foot, thus significantly reducing the space available within a shoe for the user's foot.

Referring to FIG. 5, the inventive insole includes heel cup 30, modified metatarsal pad 45, longitudinal arch support 40 and midfoot support 35. Heel cup 30 is configured as described with respect to FIG. 3 except that the medial wall 32 of cradle 31 extends into longitudinal arch support 40. At the mid region of longtitudinal arch support 40 (at about point 36), wall 32 has a maximal thickness of about 2 to 6°. Up to about dividing line 33 (lateral to which longitudinal arch support 40 merges into midfoot support 35), longitudinal arch support 40 is preferably configured in about the same manner as described with respect to medial arm 12 of heel cup 9 (FIG. 3). Longitudinal arch support 40 therefore serves to support the length of the longitudinal arch of the foot.

In addition, lateral arm 48 of heel cup 30 is separated from rnidfoot support 35 by ellipsoidal accommodative aperture 46 and, preferably, curves around and into accommodative aperture 34. Ellipsoidal aperture 46 may be open or closed by rotation of lateral arm 48 toward or away from the posterior edge of midfoot support 35. In the latter position, lateral arm 48 of heel cup 30 is in alignment with wall 38 of midfoot support 35. Further, when closed, edge 49 of heel cup 30 fits into the complementary curve of the posterior edge of midfoot support 35 (see, e.g., the partially closed position shown in FIG. 6), thus narrowing the diameter of the heel cup while leaving aperture 34 open to seat the plantar surface of the heel onto the insole of the user's shoe.

Like medial 12 of heel cup 9 (FIG. 3), longitudinal arch support arm 40 of the orthotic system of FIGS. 5 and 6 is self-adjusting in thickness insofar as it, like the other elements of the system, is formed of a deformable, yet compression-resistant material. Thus, arch support 40 is sufficiently compression-resistant to deform comfortably under relatively light stress on the arch, but can displace more substantially under greater pressure (see, Example 2 and FIG. 9). As a result, arm 40 provides both support and comfort to the longitudinal arch of the foot.

Lateral to dividing line 33, midfoot support 35 is relatively flat and thin with respect to longitudinal arch support 40. Midfoot support 35 is separated from heel cup 31 by accommodative aperture 46 and from metatarsal pad 45 by accommodative aperture 37. Midfoot support 35 extends mediolaterally from longitudinal arch 41 toward, and preferably to, the lateral edge of the user's foot.

Metatarsal pad 45 is as described except that the pad extends from the posterior edge 36 thereof rearwardly to define midfoot support 45. For ease of fit into a shoe, walls 39 and 40 of pad 45 may be substantially straight as shown in FIGS. 5 and 6, or curved as described with respect to FIG. 3. In between, surface 43 (anterior to tip 42 of accommodative aperture 37) may be relatively flat or, as described with respect to FIG. 3, may be convex to form a cushioning pad.

Metatarsal pad 45 is separated in part from midfoot support 35 by an ellipsoidal accommodative aperture 37. Aperture 37 may be rotated to an open or closed position. In the latter position, edge 39 of metatarsal pad 45 and edge 38 of midfoot support 35 are in alignment. This self-adjustment feature of the invention allows the metatarsal pad, longitudinal arch support and midfoot support elements of the orthotic system to be rotated with respect to one another to open or close the accommodative apertures of the system for customized placement and adjustment of the system within a shoe.

To better secure the orthotic system in a stable position within the user's shoe, one or two rays 50 and 51 may extend from the anterior edge of metatarsal pad 45. Alternatively, the anterior edge of pad 45 may be curved without extension as shown in FIG. 4.

In the preferred embodiment of the invention, each device is formed of a compression-resistant, deformable gel, most preferably a polyurethane gel. Alternatively, accommodative apertures of each device (which are adapted to accommodate individual variations in foot structure and shoe size) may be formed of a compressible material, preferably an open or closed cell foam, and most preferably a polyurethane foam. No rigid material (e.g., posting) is present in any of the devices.

An example of an orthotic system of the invention having accommodative apertures formed of a compressible material rather than of accommodative apertures is shown in FIG. 6. In the embodiment of FIG. 6, accommodative apertures 34 and 46 are filled with an open or closed cell polyurethane foam, while accommodative aperture 37 is unfilled. This configuration allows the user to adjust the size of the heel cup and midfoot support regions of the insole by compressing or stretching the foam material in apertures 34 and 46, while the foam provides a continuous surface to engage the plantar surface of the foot. In the insole of FIG. 6, aperture 37 is unfilled to allow maximal rotation of longitudinal arch support 40 with respect to metatarsal pad 45. Alternatively, aperture 37 may also be filled with a compressible material, while one or more of the remaining apertures may be filled or unfilled as desired.

A particularly advantageous feature of the orthotic system and devices of the invention is their construction of a compression-resistant, deformable material, most preferably a polyurethane gel. Such material retains "memory" of its shape but will deform under pressure to accommodate and adjust for stresses placed on the material during gait. In this respect, the invention is particularly beneficial as compared with prior art orthoses, which are commonly formed of compressible foam, cork, absorbent pads (e.g., of nylon, felt, cloth or the like), and/or relatively rigid, nondeformable material (e.g., resins, polypropelene, fiberglass and the like).

More specifically, each of the materials commonly used in prior art devices (such as the one depicted in FIGS. 2*a* and 2*b*, which includes compressible foam, cork, an absorbent pad and a rigid cap) has certain drawbacks when used in an orthotic device. For example, although compressible foam is capable of providing moderate levels of shock absorption, under more substantial or prolonged stress the foam will lose its shape memory, thus compromising the supportive abilities of the device. Similarly, while rigid materials such as polypropelene retain shape memory, they do not accommodate changes in motion, shoe size and the like, thus compromising the shock attenuating abilities of the device.

The use of polymer gels or foams (particularly the urethanes) overcomes many of the limitations of more compressible or rigid materials as used in orthotic devices. Urethanes in particular possess good abrasion resistance, excellent tensile strength and may be formulated over a relatively broad range of densities, hardness and elasticity as compared to other polymers. A particularly advantageous urethane gel for use in the devices of the invention is manufactured from VIBRATHANE®, Uniroyal Chemical of Elmira, Ontario, Canada. VIBRATHANE® is a polyether based polyurethane prepolymer having a specific gravity of 1.02–1.09 which can be cured to form a urethane gel for use in the orthotic system of the invention. A suitable triol based curing formulation is also available from Uniroyal under the tradename VIBRACURE™.

However, urethane gels and foams may be "tacky" to the touch, thus posing the risk that the user's foot will stick to the surface of the device. Further, although resistant to many solvents, alcohols and oils, urethanes are typically susceptible to attack (i.e., weakening of the polyester or polyether bonds) on exposure to hot water, polar solvents and concentrated acids or bases.

Particularly desirable urethane materials which are neither tacky nor substantially susceptible to attack by water and the like are a urethane gel and a urethane foam such as the ones manufactured for, and available from, Kendall Orthotics, Carlsbad, Calif. The urethane material is derived from the Uniroyal VIBRATHANE® cured gel and is modified to include vegetable fats or oils as an integral component of the material and/or as a coating over the outer surface of the material. As an integral component of the material, the vegetable fat or oil is used in approximately a 1:1 substitution for the plasticizer normally used in the urethane formulation. As a coating for the material, the vegetable fat or oil may conveniently be applied to the inner surface of a mold or otherwise incorporated by conventional manufacturing techniques which will set the coating on the outer surface of the urethane. Alternatively, the material may be coated only on its upper surface, thereby allowing the surface of the finished device which will rest upon the insole of the user's shoe to remain tacky, thus securing the device onto the insole.

Advantageously, the vegetable fat or oil used in manufacturing the urethane gel or foam will be one which contains stearic and/or oleic acids. Particularly preferred examples of such fats and oils are shea butter and avocado oil. Botanicals such as aloin (*Aloe vera* extract), aloe and cascara (which contain emodin) are also useful modifiers for urethane to be used in constructing devices of the orthotic system of the invention.

The enhanced capabilities of the orthotic system of the invention as compared to prior art orthoses are demonstrated by the comparative data set forth in the examples below. These examples should not, however, be considered to limit the scope of the invention, which is defined by the appended claims.

EXAMPLE 1

PRONATION AND SUPINATION RESISTANCE ACHIEVED BY THE ORTHOTIC SYSTEM OF THE INVENTION

To test the ability of the orthotic system of the invention to control supination and pronation during gait, two trial groups were studied by researchers in the Biomechanics Laboratory at the University of Iowa. The first group (n=?) wore shoes containing an appropriately sized orthotic system (i.e., the system represented by FIG. 5). The second group (n=?) consisted of the same people wearing brand and style matched shoes without any orthotic device.

The biomechanical characteristics of each person during the trial period was measured by electronic detection of pronation and supination during gait over equal distances for equal periods of time. Pronation and supination were determined by reference to a neutral balance point; i.e., the position that the foot of each person would be in while standing in a stationary, natural position.

Figure 7:
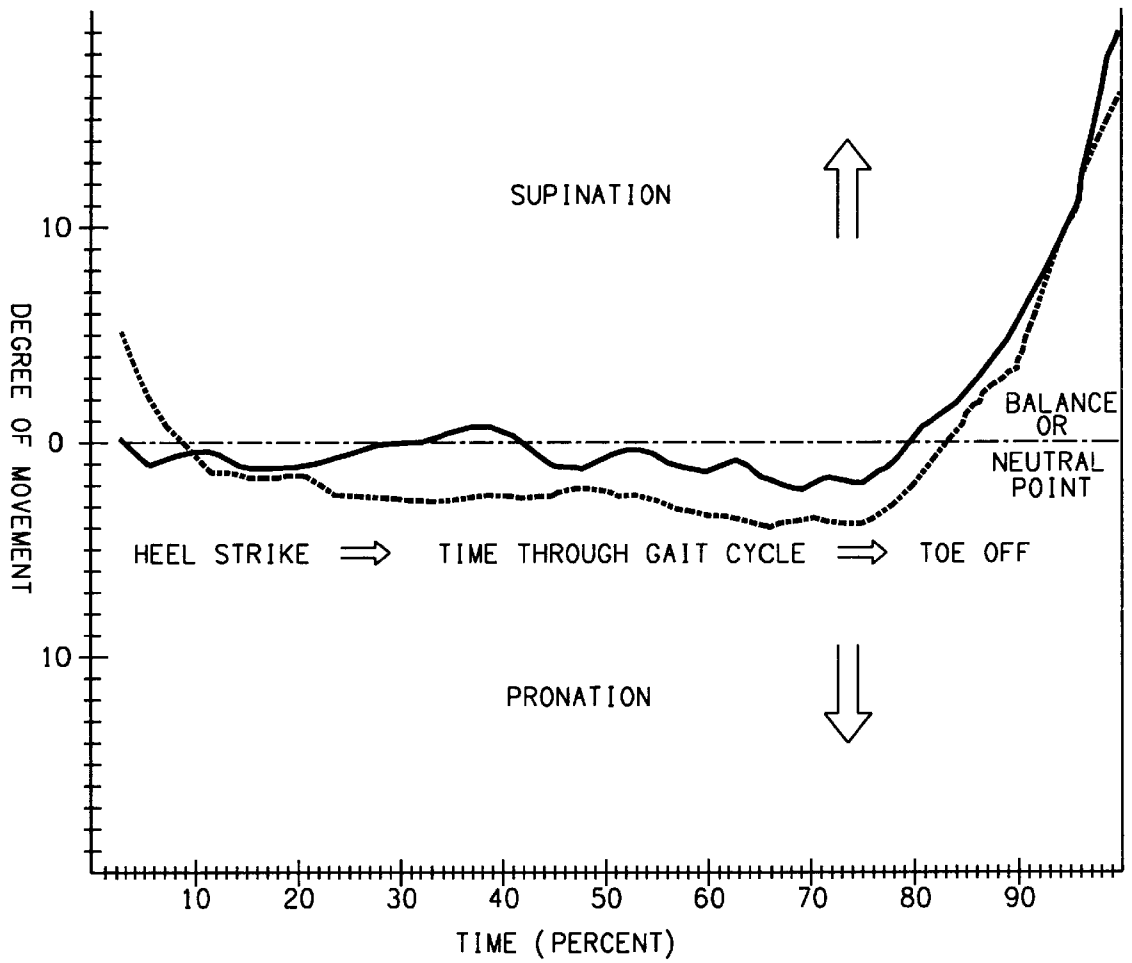
FIG. 7 is a graph depicting the results of a first biomechanical trial of the orthotic system of the invention to determine its effectiveness in providing the user with resistance to pronation and supination during gait. The y axis of FIG. 7 shows variations in movement with respect to a natural balance point, while the x axis of FIG. 7 shows the time elapsed during gait (single step).

The results of the trial are shown in FIG. 7. Values shown are average (?) values obtained for each trial group. The balance point is indicated by a hatched horizontal line. The y axis of FIG. 7 represents the degree of movement detected (where 0 is the balance point and 10 is a maximal value before toe-off). The x axis of FIG. 7 represents time in seconds during gait. The light gray line indicates values obtained in the second group, while the solid black line represents values obtained in the first group.

As demonstrated in FIG. 7, the orthotic system of the invention was significantly effective in resisting pronation and maintaining the foot of the user (persons in group 1) near the balance point throughout gait.

For verification of results, the trial was repeated in two trial groups comprised of people other than those who participated in the trial described above. The conditions of the second trial were otherwise the same as the conditions of the first trial, except that the members of the trial group stopped moving at the end of the trial period rather than continuing to move forward through toe-off.

Figure 8:
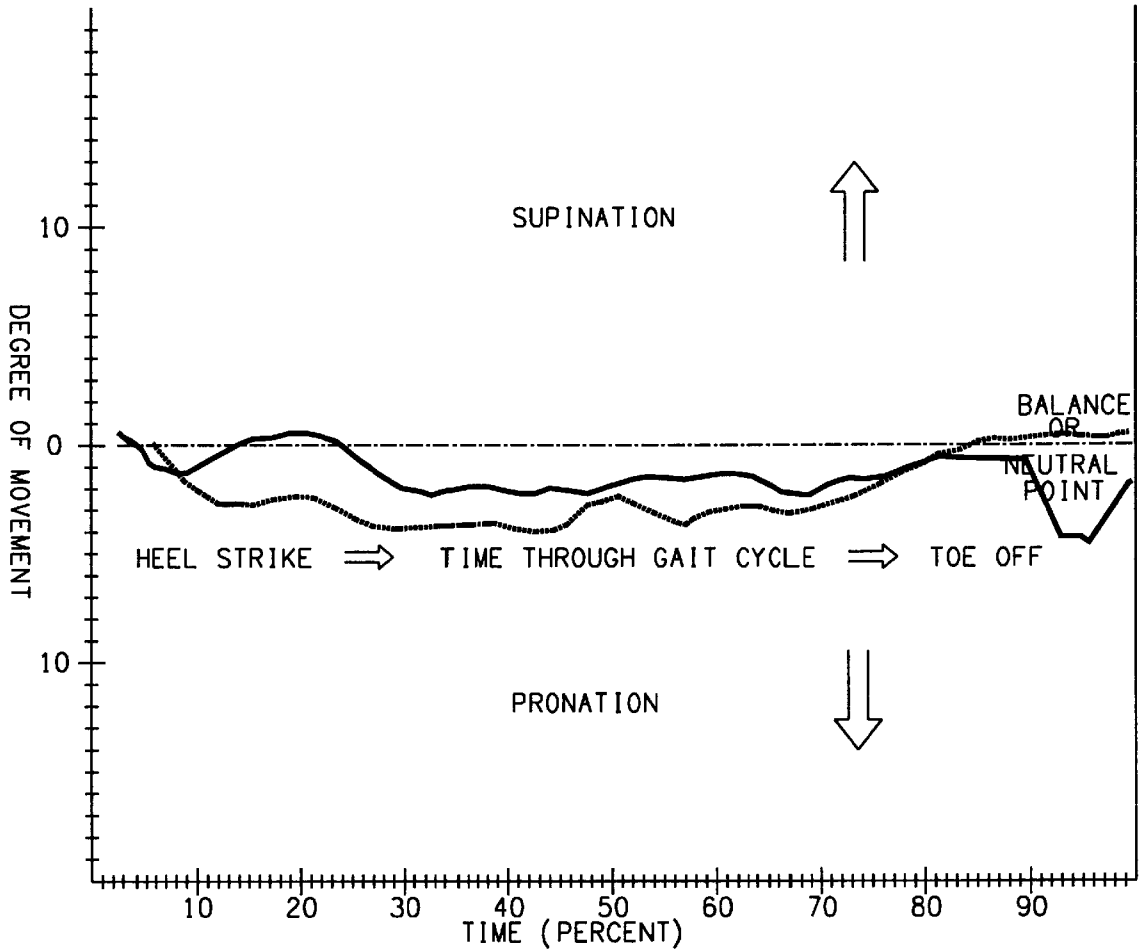
FIG. 8 is a graph depicting the results of a second biomechanical trial of the orthotic system of the invention to determine its effectiveness in providing the user with resistance to pronation and supination during gait. The y axis of FIG. 8 shows variations in movement with respect to a natural balance point, while the x axis of FIG. 8 shows th elapsed during gait (single step followed by stop).

As shown in FIG. 8, the orthotic system of the invention was significantly effective in resisting pronation and maintaining the foot of the user near the balance point throughout gait to the point that forward motion was stopped.

EXAMPLE 2

SHOCK ABSORPTIVE CHARACTERISTICS OF THE ORTHOTIC SYSTEM OF THE INVENTION

To test the ability of the orthotic system of the invention to absorb shock to the foot during gait, three trial groups were studied by researchers in the Exeter Research Laboratory in Exeter, N.H. The first comprised samples of the orthotic system of the invention (i.e., the system represented by FIG. 5). The second group consisted of samples of a foam orthotic device (full insole) which is sold commercially under the tradename Spenco PSII™ for use in shock attenuation. The third group consisted of samples of a foam orthotic device (full insole) which is sold commercially under the tradename IMPAC PLUS™ for use in shock attenuation.

The trial was conducted by impacting the samples of each group with a striking device set to strike each sample with identical force (30 g). Shock absorption was measured by detecting the extent to which the force was transmitted through the samples to a surface at the point of impact.

Figure 9:
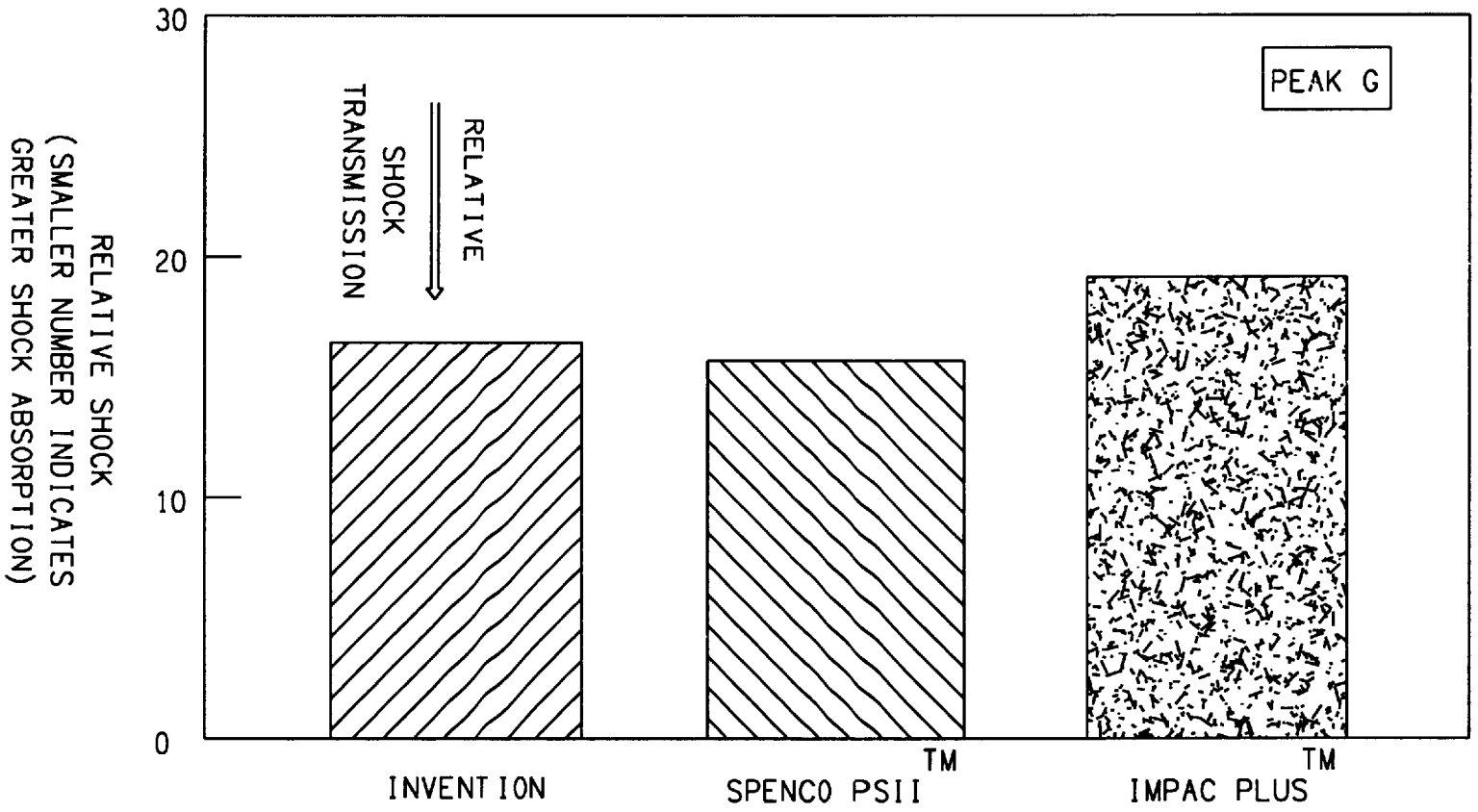
FIG. 9 is a bar graph depicting the results of a shock absorption test of the orthotic system of the invention in comparison to two prior art devices. The y axis of FIG. 9 shows the total force available for transmission or absorption by each tested deice, while the x axis identifies each tested device.

The results of the trial are shown in FIG. 9. The y axis of the FIGURE shows the force from 0 g to 30 g. Each trial group is identified along the x axis. The extent to which force was transmitted through each sample is shown in the gray bars as the g force detected; lower values indicate greater shock absorption.

As demonstrated in FIG. 9, the orthotic system of the invention was significantly effective in absorbing the shock of impact applied to it, thus indicating that the system will effectively resist transmission of shock during gait to a user's foot. In comparison to the prior art devices also tested, the orthotic system of the invention possessed shock absorptive capabilities equivalent to those of the Spenco PSII™ (scoring 16.49 g of shock transmission for the inventive system v. 15.8 g of shock transmission for the Spenco device) and considerably better capabilities than those of the IMPAC PLUS™ device (which transmitted 19.3 g to the test surface).

A number of embodiments of the present invention have been described. Nevertheless, it will be understood that various modifications may be made without departing from the spirit and scope of the invention. Accordingly, it is to be understood that the invention is not to be limited by the specific illustrated embodiment, but only by the scope of the appended claims.

I claim:

1. An substantially U-shaped orthotic heel cup formed throughout of a compression-resistant, deformable material seatable into a user's shoe, having an insole comprising:

(a) a lateral and medial arm rotatable toward and away from one another;

(b) a bight adapted to engage and surround a user's heel, which bight, together with the arms, defines an accommodative aperture through which the heel will rest on the insole;

wherein the medial arm of the heel cup extends from the bight of the heel cup to at least an anterior point which, when in use, is approximately perpendicular with an anteriormost point of the longitudinal arch of the user's foot; and, wherein further the medial arm of the heel cup has a mid portion that is about one to three times thicker than the bight of the heel cup.

2. The heel cup according to claim 1 wherein the compression-resistant, deformable material is a gel or foam.

3. The heel cup according to claim 2 wherein the gel or foam is a urethane.

4. The heel cup according to claim 1 wherein the heel cup arms and heel cup bight are wedge-shaped such that the wedge has a horizontal side, an inner vertical side and an opposite outer vertical side, and wherein further the horizontal side of the wedge rests on the insole of the user's shoe.

5. The heel cup of claim 4 wherein the inner vertical side of the wedge is concave.

6. The heel cup of claim 1 wherein the medial arm is provided with at least one accommodative aperture.

* * * * *